US008590554B2

(12) United States Patent
Choi et al.

(10) Patent No.: US 8,590,554 B2
(45) Date of Patent: Nov. 26, 2013

(54) FOLDABLE TENT WITH INTEGRATED VENTILATION SYSTEM

(75) Inventors: Kwan Jun Choi, Hamyang-gun (KR); Ki Ho Jin, Xiamen (CN)

(73) Assignee: Ki Ho Jin, Xiamen (CN)

( * ) Notice: Subject to any disclaimer, the term of this patent is extended or adjusted under 35 U.S.C. 154(b) by 52 days.

(21) Appl. No.: 13/295,396

(22) Filed: Nov. 14, 2011

(65) Prior Publication Data

US 2012/0055525 A1 Mar. 8, 2012

Related U.S. Application Data

(63) Continuation-in-part of application No. 12/658,473, filed on Feb. 4, 2010, now Pat. No. 8,448,656.

(30) Foreign Application Priority Data

Nov. 30, 2007 (CN) ..... 2007 2 0008991 U
Aug. 4, 2011 (CN) ..... 2011 2 0281609 U

(51) Int. Cl.
*E04H 15/44* (2006.01)
*E04H 15/14* (2006.01)

(52) U.S. Cl.
USPC ..... 135/135; 135/93; 135/147; 135/120.2

(58) Field of Classification Search
USPC ..... 135/135, 120.2, 125, 136, 147, 93, 94, 135/114, 120.3
See application file for complete search history.

(56) References Cited

U.S. PATENT DOCUMENTS 14,655 A 4/1856 Hartwell
58,283 A 9/1866 Palmer
379,274 A 3/1888 Hamilton
2,113,118 A 4/1938 Pyatt
2,306,706 A 12/1942 Lucas
2,448,895 A 9/1948 Lawrence
2,530,765 A 11/1950 Greenup
2,555,220 A 5/1951 Brown
2,731,972 A 1/1956 Braun (Continued)

FOREIGN PATENT DOCUMENTS

CA 2022369 A1 2/1991
CN 2506736 Y 8/2002

(Continued)

OTHER PUBLICATIONS

International Search Report, Jan. 22, 2009.

*Primary Examiner* — Noah Chandler Hawk
(74) *Attorney, Agent, or Firm* — John H. Choi

(57) ABSTRACT

The present invention provides an instant tent with an integral vent and corresponding rain fly for providing the tent with continuous ventilation while protecting the vent and interior of the tent from adverse weather conditions. The frame of the tent includes a hub, a plurality of roof poles and eave poles pivotally coupled to the hub, and a plurality of leg poles coupled to the corresponding roof poles. Coupled to the frame is an enclosed canopy which includes the vent at a top portion of the canopy to allow air from continuously entering and exiting the interior of the tent. The rain fly is attached to the canopy and corresponding eave pole, and is disposed proximate the vent. Thus, the instant tent of the present invention is provided with secure and continuous ventilation, and is opened and closed without requiring additional assembly of components.

19 Claims, 9 Drawing Sheets

(56) References Cited

U.S. PATENT DOCUMENTS

| | | | | |
|---|---|---|---|---|
| 2,962,034 | A | 11/1960 | Finlayson | |
| 2,984,249 | A | 5/1961 | Sears, Jr. et al. | |
| 3,333,373 | A | 8/1967 | Taylor et al. | |
| 3,374,798 | A * | 3/1968 | Samuelson | 135/33.7 |
| 3,738,378 | A | 6/1973 | Williams | |
| 3,810,482 | A | 5/1974 | Beavers | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,971,090 | A | 11/1990 | Uhl | |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,797,695 | A | 8/1998 | Prusmack | |
| 5,871,026 | A * | 2/1999 | Lin | 135/98 |
| 5,884,646 | A | 3/1999 | Ju | |
| 5,943,837 | A | 8/1999 | Esser et al. | |
| 6,021,795 | A | 2/2000 | Long et al. | |
| 6,021,796 | A * | 2/2000 | Vavra | 135/147 |
| 6,032,430 | A | 3/2000 | Soukup | |
| 6,167,898 | B1 | 1/2001 | Larga et al. | |
| 6,286,530 | B1 | 9/2001 | Hussey | |
| 6,296,415 | B1 | 10/2001 | Johnson et al. | |
| D470,907 | S * | 2/2003 | Ju | D21/834 |
| 6,516,823 | B1 | 2/2003 | Glover et al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,772,780 | B2 | 8/2004 | Price | |
| 6,776,179 | B1 | 8/2004 | Chen | |
| 6,854,476 | B1 | 2/2005 | Chai | |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| 7,401,618 | B2 * | 7/2008 | Caldwell | 135/33.7 |
| RE40,544 | E | 10/2008 | Suh | |
| 7,481,235 | B2 | 1/2009 | Prusmack | |
| 7,546,845 | B2 | 6/2009 | Prusmack | |
| 2003/0005953 | A1 | 1/2003 | Erbetta et al. | |
| 2007/0215192 | A1 | 9/2007 | Hoffman | |
| 2012/0125389 | A1 * | 5/2012 | Vaughn et al. | 135/94 |

FOREIGN PATENT DOCUMENTS

| | | | |
|---|---|---|---|
| CN | 2635827 | Y | 8/2004 |
| CN | 201129060 | Y | 10/2008 |
| GB | 2201703 | A | 9/1988 |
| GB | 2259927 | A | 3/1993 |

* cited by examiner

FOLDABLE TENT WITH INTEGRATED VENTILATION SYSTEM

This application is a continuation-in-part of U.S. patent application Ser. No. 12/658,473 filed on Feb. 4, 2010, which is incorporated by reference in its entirety.

BACKGROUND OF THE INVENTION

1. Field of the Invention

The present invention relates to a foldable tent and more particularly to an instant tent with an integrated ventilation system and rain fly.

2. Description of Prior Art

For novice campers, foldable tents are a popular alternative to conventional assemble-to-use tents. Foldable tents, which are commonly referred to as "instant tents," "one-touch tents" or "pop-up tents," are sold preassembled, making opening and closing of the tent easy and less time consuming.

Instant tents are sold in several different designs. One type of instant tent, for example, is manufactured and sold as a structure similar to that of a conventional umbrella as shown, for example, in U.S. Pat. No. 6,581,617. In those structures, the tent is opened and collapsed by movable sub-braces which are pivotally connected to a central shaft. These structures often times have locking mechanisms on the central shaft to maintain the tent in the open state. Umbrella type instant tents, however, are problematic for a number of reasons which include but are not limited to: (1) the additional costs in manufacturing due to the parts required for the tent, i.e., the central shaft, sub-braces and locking mechanism, as well as increased labor to assemble those parts; (2) the increased potential for failure and necessary repair of the central shaft, sub-braces and locking mechanism; and (3) the increased size and weight of the tent due to the extra components.

To overcome the disadvantages of umbrella tents, an instant tent that does not require a central shaft, sub-braces or locking mechanism was developed. As described in U.S. patent application Ser. No. 12/658,473 ("the '473 Application"), the poles are pivotally connected directly to the hub, and pivot to and from open and closed configurations without additional components. Even though the instant tent described in the '473 Application solved many of the problems associated with umbrella type instant tents as well as the disadvantages in other instant tents, there was room for improvement to develop a better design to accommodate the user.

First, tents in general lack sufficient ventilation. For most novice campers, tents are used during the summer season and often times the interior of the tent becomes uncomfortably warm and sometimes even hot. Moreover, condensation can develop due to the lack of air circulation. Even though tents are commonly equipped with screen windows or doors on one or more sides of the tent, it is difficult to achieve sufficient ventilation unless a wind or draft is blowing directly into an open window or door and out another open window or door. When adverse weather conditions are present, such as rain or snow, the windows and doors must be closed to prevent rain or snow from entering the tent and thus the interior of the tent cannot ventilate. Furthermore, when a user wishes to close the windows or doors for other reasons such as for safety or privacy it is difficult to ventilate the interior of the tent.

Second, even though some instant tents are sold with a separate cover or fly to protect the tent from adverse weather conditions such as rain, sleet or snow, or to provide shade from the sun light, the cover or fly is not integrated with the instant tent and, thus, the user is required to separately attach and detach the cover or fly to and from the instant tent. In addition, because the rain fly typically covers most of the tent including the windows, it is not possible to achieve proper ventilation.

OBJECTS AND SUMMARY OF THE INVENTION

The present invention is intended to overcome at least the above-described disadvantages and to provide further improvements to instant tents in the prior art. The objects and advantages of the present invention, more specifically, are to provide instant tents with improved ventilation at all times including when the windows and doors are closed, and during inclement weather conditions; and to provide a rain fly integral to the instant tent such that the user could simply open and close the tent without having to attach additional components to the instant tent.

For achieving the above-mentioned objects, the present invention generally provides a permeable fabric such as a mesh fabric integrated to the tent canopy at or near a top portion of the tent canopy. The instant tent is also provided with an integral rain fly at or near the permeable fabric to provide the tent with additional protection from various weather conditions while maintaining sufficient ventilation of the interior of the tent.

More specifically, the present invention provides an instant tent, convertible between open and closed configurations, comprising a central hub with a base having an engaging surface. First and second sets of slots are formed on the engaging surface of the base, and each slot is formed by first and second slot walls and the engaging surface of the base. Each of the first and second slot walls extend independently from the engaging surface of the base and substantially parallel to each other. The first set of slots comprises at least three slots spaced apart radially and the second set of slots comprises at least one slot disposed between adjacent slots of the first set. The instant tent further comprises at least one eave pole corresponding to the number of slots of the second set of slots. Each eave pole has first and second ends and each eave pole first end is pivotally coupled to a corresponding slot of the second set. The instant tent further comprises a plurality of roof poles corresponding to the number of slots of the first set of slots. Each roof pole has a first and second end and each roof pole first end is pivotally coupled to a corresponding slot of the first set. The instant tent further comprises a plurality of leg poles corresponding to the number of roof poles. Each leg pole has a middle section and a lower section and each middle and lower section has a first end and a second end. Each roof pole second end is coupled to a corresponding middle section first end, and said middle section second end is coupled to a corresponding lower section first end. The instant tent further comprises a canopy having a plurality of adjoining canopy walls and a floor coupled together at seams to form an enclosure. Each canopy wall has a top, bottom and two side portions and at least one of the canopy walls has a vent. The canopy is continuously connected to the roof poles and leg poles in the open and closed configurations. The instant tent further comprises at least one rain fly disposed proximate the vent. The at least one rain fly has a plurality of perimeters and the at least one rain fly is continuously connected to the canopy and corresponding eave pole in the open and closed configurations.

In one embodiment of the present invention, the instant tent of the present invention includes a hub assembly comprising a base having first and second surfaces. The hub assembly further comprises first and second sets of slots. The first set of slots comprises at least three slots spaced apart radially and the second set of slots comprises at least one slot disposed between adjacent slots of the first set. Each slot is formed by first and second slot walls, and each of the first and second slot walls extend independently from the first surface of the base and substantially parallel to each other. Each slot wall also has an inner and outer end. The hub assembly also comprises a plurality of roof poles corresponding to the number of slots of the first set of slots. Each roof pole has a first and second end and each roof pole first end is pivotally coupled to first and second slot walls of a corresponding slot of the first set. The hub assembly further comprises at least one eave pole corresponding to the number of slots of the second set of slots. Each eave pole has first and second ends and each eave pole first end is pivotally coupled to first and second slot walls of a corresponding slot of the second set. In the open configuration the first ends of each roof pole and eave pole engage the first surface of the base, and in the closed configuration said first ends are disengaged from the first surface of the base and pivoted substantially perpendicular to said top surface.

In another embodiment of the present invention, the instant tent includes a hub assembly comprising a base having first and second surfaces, and first and second sets of slots. The first set of slots comprises at least three slots spaced apart radially. The second set of slots comprises at least one slot disposed between adjacent slots of the first set. Each slot is formed by first and second slot walls and each of the first and second slot walls extend independently from the second surface of the base and substantially parallel to each other. Each slot wall has an inner and outer end. The hub assembly further comprises a plurality of roof poles corresponding to the number of slots of the first set of slots. Each roof pole has a first and second end. Each roof pole first end is pivotally coupled to first and second slot walls of a corresponding slot of the first set. The hub assembly further comprises at least one eave pole corresponding to the number of slots of the second set of slots. Each eave pole has first and second ends and each eave pole first end is pivotally coupled to first and second slot walls of a corresponding slot of the second set. In the open configuration the first ends of each roof pole and eave pole engage the second surface of the base, and in the closed configuration said first ends are disengaged from the second surface of the base and pivoted substantially perpendicular to the base.

DETAILED DESCRIPTION OF THE PREFERRED EMBODIMENTS

Figure 1:
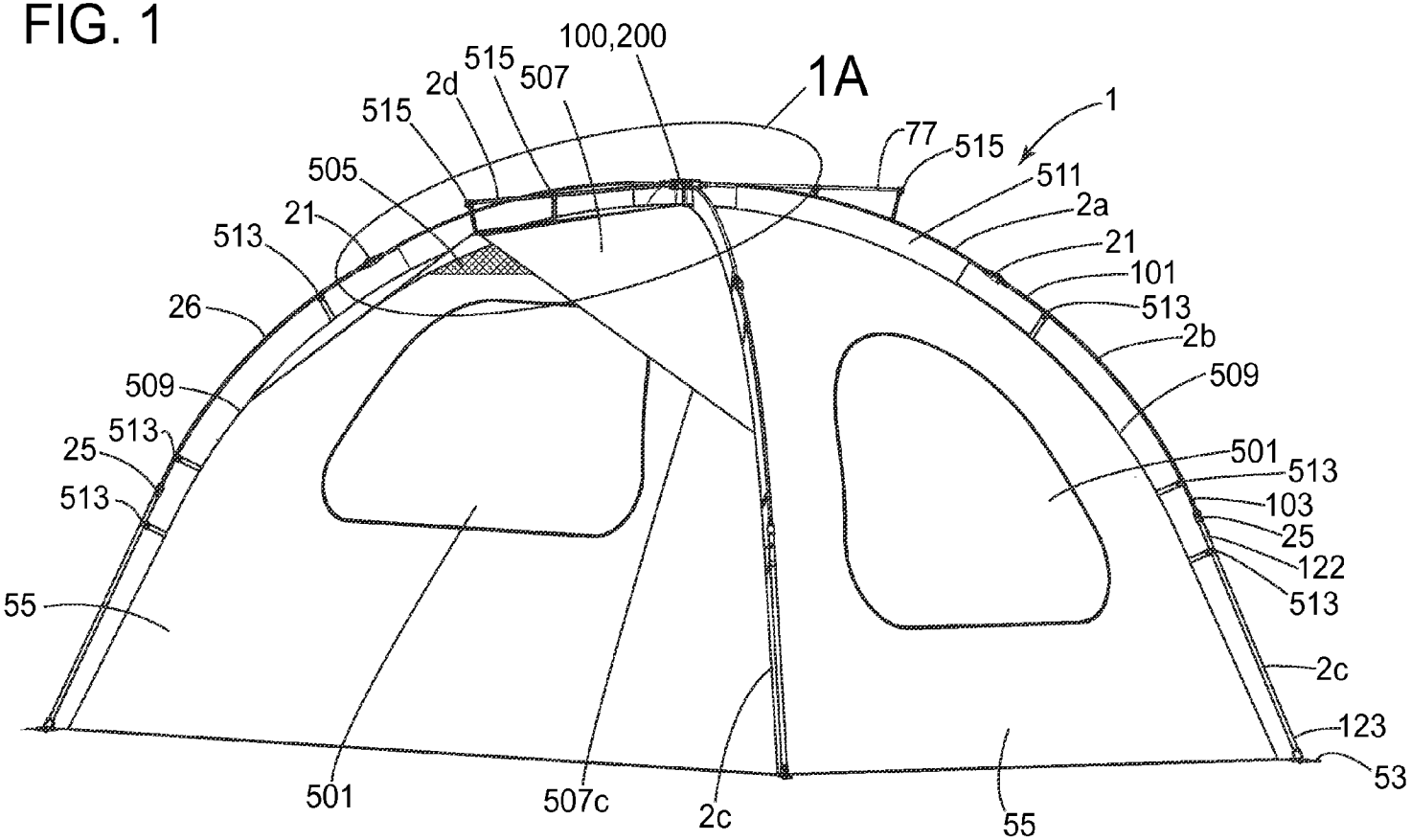
FIG. 1 is a side perspective view of the instant tent of the present invention in an open configuration.
Figure 11A:
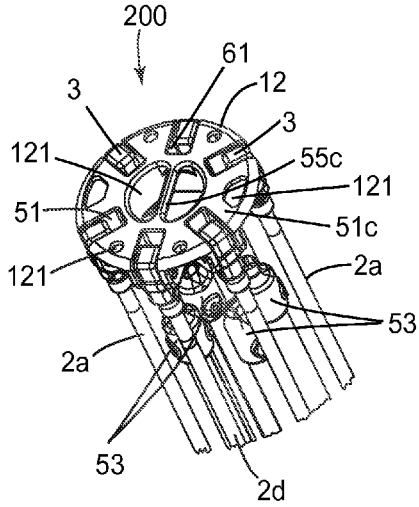
FIG. 11A is a partial bottom perspective view of the frame shown in FIG. 9 in a closed or folded configuration.
Figure 11B:
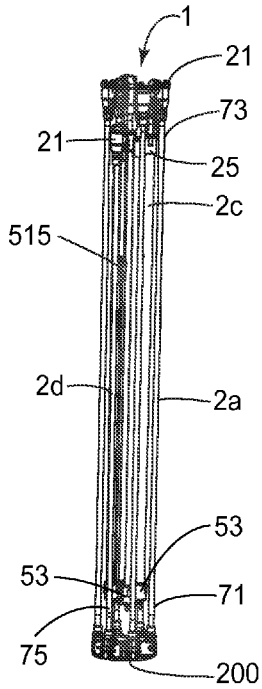
FIG. 11B is a side perspective view of the frame shown in FIG. 9 in a closed or folded configuration.

Referring to FIG. 1, a foldable tent 1 of the present invention is shown. The foldable tent is opened or erected to an open configuration as shown in FIG. 1, and folded or collapsed to a collapsed configuration as shown in FIG. 11B, without requiring assembly or disassembly of any parts.

Referring to FIGS. 1, 6 and 8A-D, the foldable tent 1 is centrally supported by a hub 100, 200. In the preferred embodiment, the hub 100, 200 is circular but the shape of the hub 100, 200 can be modified to other shapes including but not limited to square, hexagon or octagon shapes. The hub 100, 200 is preferably formed of a tough, molded plastic but can also be constructed with other materials and methods without departing from the scope of the invention. The hub 100, 200 can also be molded such that it includes voids 121, as shown in FIGS. 8A-D, to reduce the weight of the hub as well as manufacturing costs.

Figure 6:
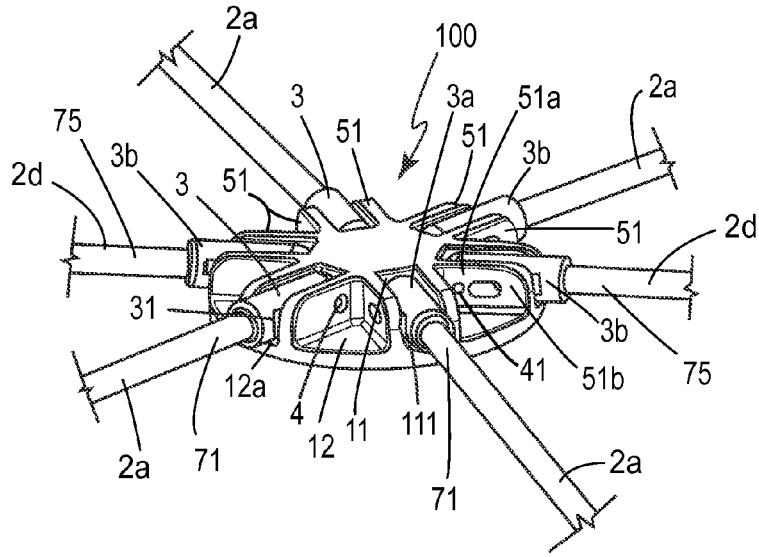
FIG. 6 is a perspective view of a first embodiment of a hub assembly of the present invention in an open configuration.

Referring to FIG. 6, in the first embodiment, the hub 100 comprises a stopper or base 12 having a top surface 12*a* and a bottom surface 12*b*. The base 12 includes a plurality of cabinets or slots 11 provided on the top surface of the base 12*a* and arranged in radial configuration. Each slot 11 is formed by a pair of adjacent walls 51, each having an inner end 51*a* and an outer end 51*b*, extending independently from the base top surface 12*a*. The inner surfaces of each wall 51 preferably include a curved groove 111 but the walls 51 can also function within the scope of the invention without the curved grooves 111. The walls of each slot 51 are also provided with pivoting holes 41 located at a radially inner end of the walls 51*a* and are substantially aligned. In the first embodiment, the base 12 uniformly extends radially and provides a surface below each entire slot 11.

Referring to FIGS. 8A-D, the connecting hub 200 of the second embodiment is shown. Here, the general structure of the hub 200 is similar to the hub of the first embodiment 100 with a few exceptions. First, the pivoting cabinets or slots 11 extend downward from the bottom surface of the base 12*b*. Second, the walls of each slot 51 have pivoting holes 41 located at a radially outer end of the walls 51*b* such that the holes 41 are substantially aligned. Third, the base portion 12 of each slot 11 is only partially extended radially outward such that an opening or void 61 extends radially outward through the rest of the slot 11 including below the pivoting holes of the walls 41. Fourth, a platform 51*c* having voids 121 extends radially outward between lower portions of adjacent slots 11 to provide additional strength to the slots 11.

Referring to FIG. 1, in the preferred embodiment, the tent 1 further comprises four flexible poles to form the frame of the tent, even though the tent 1 can operate with as few as three poles (see FIG. 7) and without limitation to the number of poles. A variety of materials such as metal tubing, composite tubing (tubing made of resin impregnated fibers), solid composite poles, flexible fiberglass poles, or any combination thereof could be used. Preferably a roof pole (or upper section) 2*a*, and a leg pole comprising a middle section 2*b* and a lower section 2*c*are connectable together. One or more of the pole sections 2*a*, 2*b*, 2*c* could be hollow to reduce the overall weight as well as manufacturing costs of the tent 1. The tent 1 can also be provided with any number of pole sections depending on the desired height of the tent in its open and collapsed configurations.

Figure 1A:
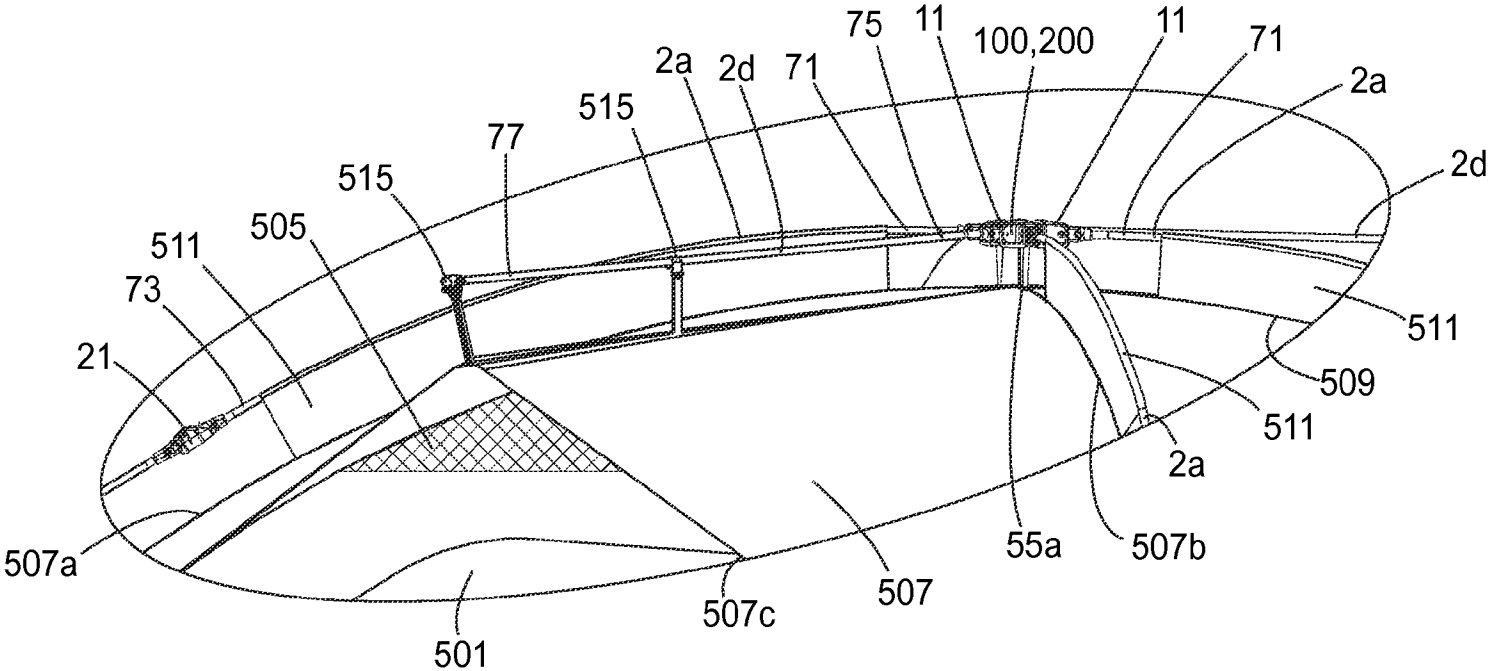
FIG. 1A is a partial perspective view of the top portion of the instant tent of FIG. 1, which is denoted "1A" in FIG. 1.
Figure 2A:
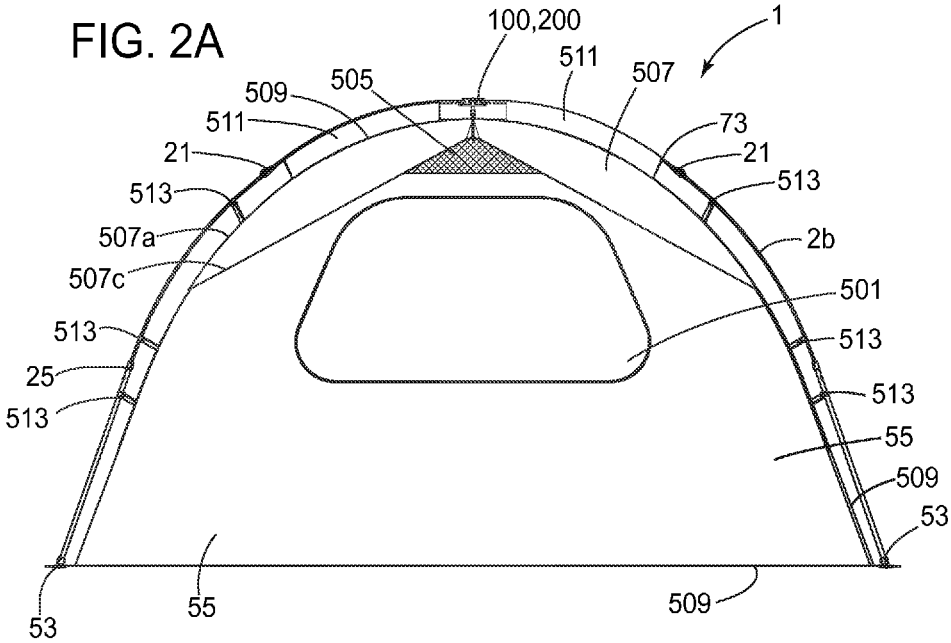
FIG. 2A is a side view of the instant tent shown in FIG. 1.
Figure 2B:
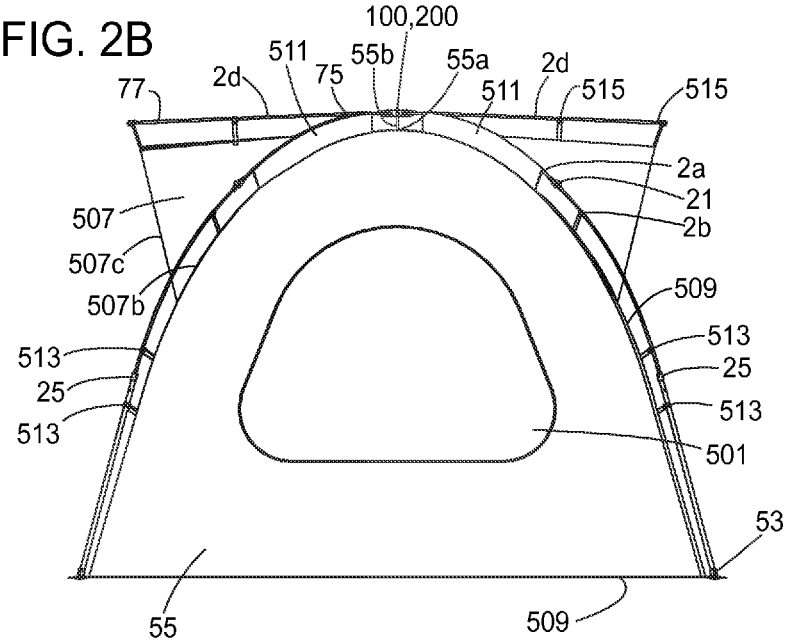
FIG. 2B is an alternate side view of the instant tent shown in FIG. 1.
Figure 3:
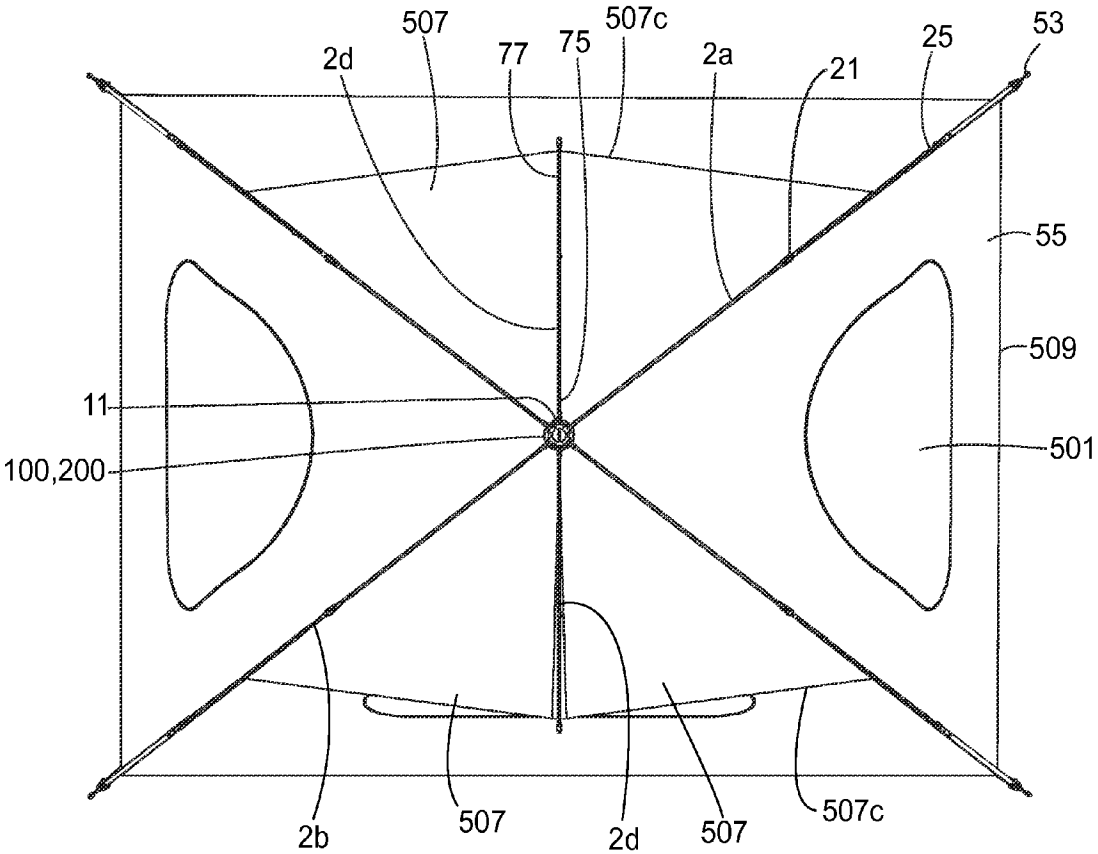
FIG. 3 is a top view of the instant tent shown in FIG. 1.

Referring to FIG. 1A, each roof pole 2*a* has first and second ends 71, 73, and forms a roof portion of the tent 1. Referring to FIG. 6, in one embodiment, a substantially tubular pivoting cap 3, having first and second ends 3*a*, 3*b*, is secured to the first end of each roof pole 71. The caps 3 are constructed of a hard, molded plastic and provide the roof poles with additional protection from wear. The cap second end 3*b* is sufficiently secured onto the roof pole first end 71 by form-fit and/or adhesive but can also be secured via fastener 3*d* as shown in FIGS. 8A-D. The cap 3 may also include a curved outer surface 31 to correspond to the curved grooves 111 of the walls 51 of each slot 11. Therefore, the external diameter of each pivoting cap 3 is slightly less than or equal to the distance between the inner surfaces of the walls 51 of each slot 11 to allow for each corresponding cap 3 to fit snugly into the slot 11 but also to allow the caps 3 to disengage from each slot 11 without excessive force. Referring to FIGS. 8A-D, it is preferred that the caps 3 are constructed such that the surface of the caps 3 contacting the slot walls 51 as well as the slot walls 51 are substantially flat while maintaining a close fit. However, the caps 3 and slots 11 can be modified to other shapes and sizes to provide a close fit without departing from the spirit and scope of the present invention.

Figure 7:
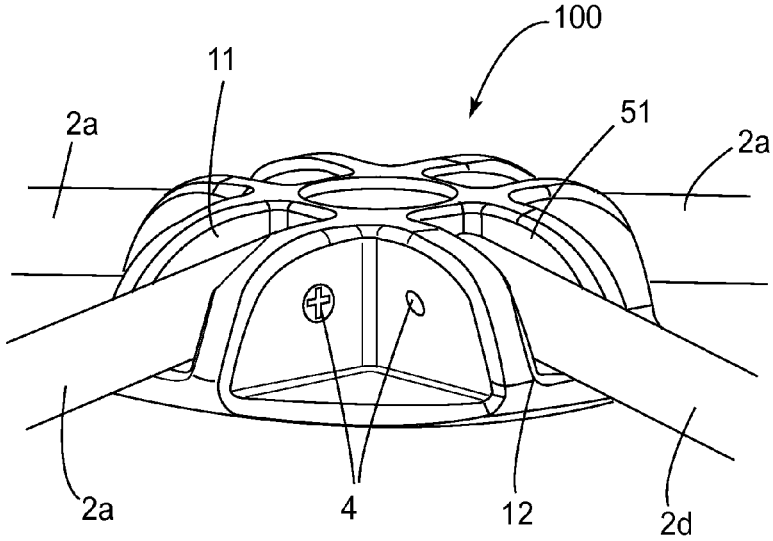
FIG. 7 is a perspective view of an alternative embodiment of a hub assembly of the present invention in a open congfiguration.

Referring to FIGS. 6 and 8A-D, each cap 3 also has holes extending through opposing sides of the cap 3 such that the holes are substantially aligned. In the first embodiment, as shown in FIG. 6, the holes are located at the cap first end 3*a*. In each slot 11, a fastener or pivoting pin 4 extends through the holes of the cap 3 as well as the pivoting holes 41 located at the inner end of each wall 51*a*, thereby forming a pivoting axis for the roof poles 2*a*. In the second embodiment, the aligned holes are located at or near the cap second end 3*b* and a fastener 4 extends through each cap as well as the pivoting holes 41 located on the outer end of each wall 51*b* to form a pivoting axis. Alternatively, the roof poles 2*a* can be directly connected to the slots 11 without a pivoting cap as shown in FIG. 7. The pivoting pin 4 can be any type of fastener such as a rivet, rod, bolt or screw.

Referring again to FIGS. 1, 6 and 8A-D, the instant tent also includes eave poles 2*d*, having first and second ends 75, 77 pivotally connected to the slots 11 in the same manner as the roof poles 2*a* as described above. In the one embodiment, as shown in FIGS. 1, 3, 6, 8A-D, two eave poles 2*d* are included and each eave pole 2*d* is located on opposite sides of the base 12 between the roof poles 2*a* and extends radially outward at a length slightly shorter than the width of the tent 1. In an another embodiment, shown in FIGS. 4-5, four eave poles 2*d* are included. Thus, one skilled in the art will recognize that the number, length and location of the eave poles can vary. Moreover, the eave poles could have one of more extensions that are slidably or pivotally coupled, for example, by a pivoting joint 21 as shown in FIG. 9, to accommodate rain flies of any size or shape.

One of ordinary skill in the art will also recognize that the pole sections 2*a*, 2*b*, 2*c* can also be coupled by other means, uniformly or in combination, including slidably, pivotably or by securing the pole sections 2*a*, 2*b*, 2*c* together by and elastic cord extending through the interior of the poles.

In the first embodiment, shown in FIG. 6, the base 12 uniformly extends radially and provides a surface 12*a* below the pivoting pins 4 and caps 3 so that the first ends of each roof pole and eave pole 71, 75 can pivot to and from the open and closed configurations within each corresponding slot 11. The base 12 is extended to cover the area under the caps 3 to relieve the stresses exerted on the roof poles 2*a* but one of ordinary skill in the art will recognize that the base 12 need not extend fully to provide a surface to cover the entire length of the caps 3.

Figure 8C:
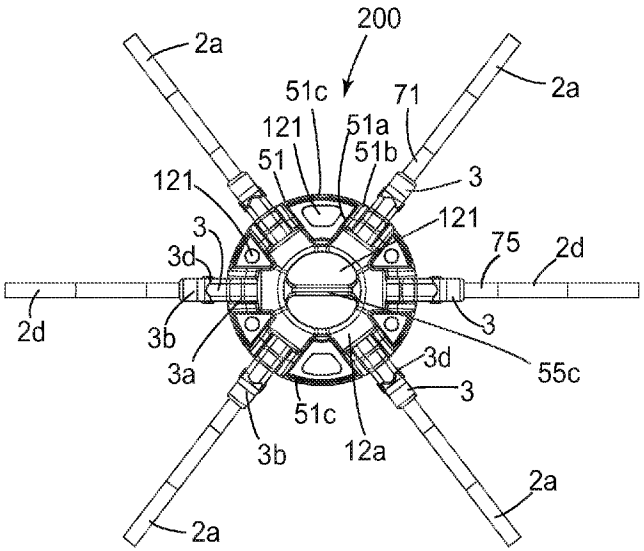
FIG. 8C is a top view of the hub assembly shown in FIG. 8A.
Figure 8D:
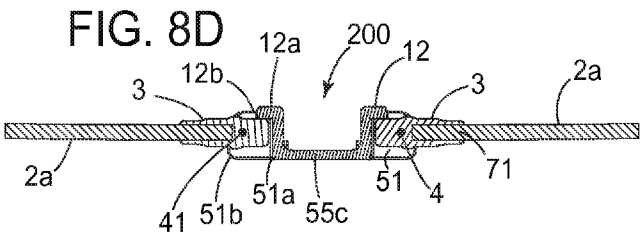
FIG. 8D is a sectional view of the hub assembly shown in FIG. 8A.
Figure 8A:
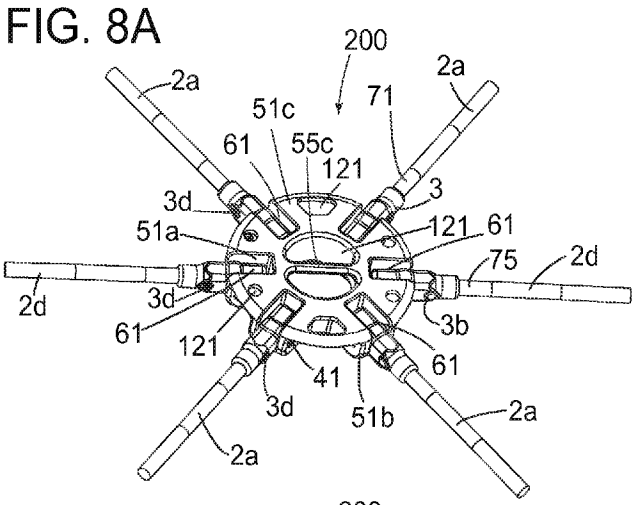
FIG. 8A is a bottom perspective view of a second embodiment of a hub assembly of the present invention.
Figure 8B:
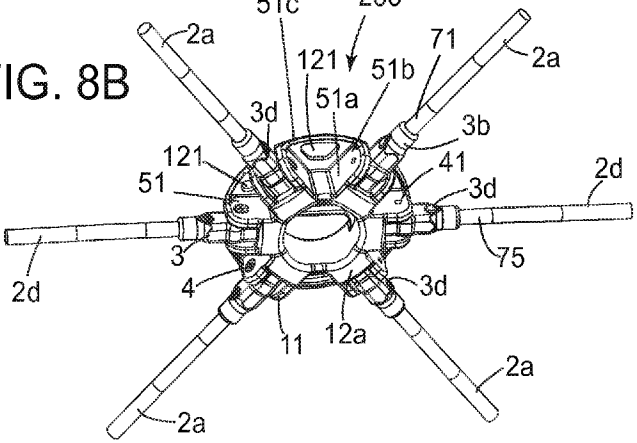
FIG. 8B is a top perspective view of the hub assembly shown in FIG. 8A.
Figure 9:
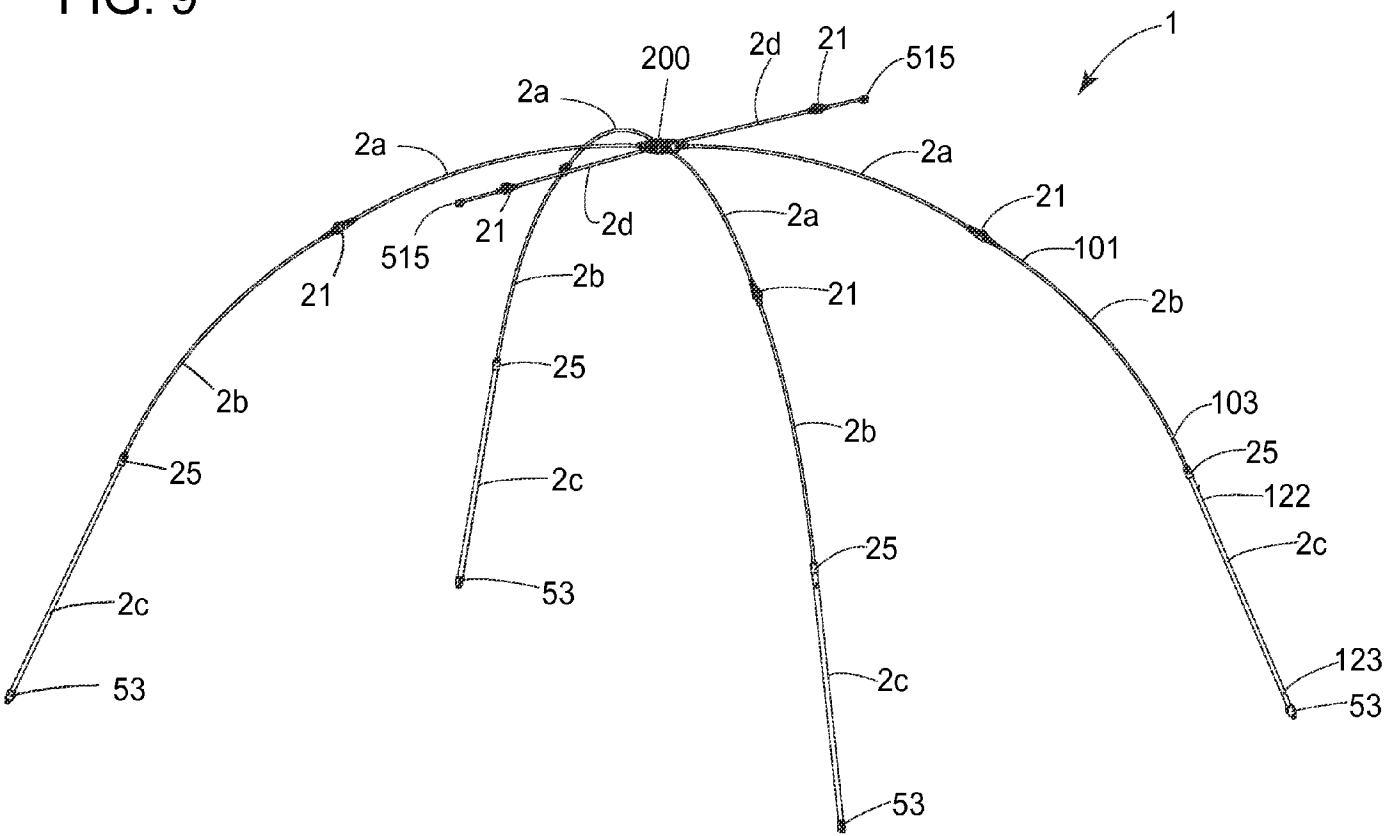
FIG. 9 is a perspective view of an alternative embodiment of a frame of the instant tent of the present invention.

Referring to FIGS. 8A-D, in the second embodiment, the base 12 extends radially outward except that the base 12 does not extend above the radially outer portions of the slots 11 where the caps 3 are pivotally connected to the walls 51, thereby forming an opening or a void 61. Thus, in the open configuration, as shown in FIG. 8D, the bottom surface of the base 12*b* restricts the caps 3 and first ends of each the roof pole and eave pole 71, 75 from any upward pivotal movement beyond the bottom surface of the base 12*b*. As a result, the roof pole and eave pole first ends 71, 75 are secured in a substantially horizontal position or substantially parallel to the bottom surface of the base 12*b*. Referring to FIG. 11A, in the closed configuration, the opening 61 provided on the radially outer portions of the slots 11 allow the pole second ends 73, 77 to pivotally move upward while all or a substantial portion of the caps 3 located at the pole first ends 71, 75 remain below a horizontal plane extending from the top surface of the base 12*a* in the closed configuration.

Referring to FIGS. 1 and 9, the leg pole middle section 2*b* has a first end 101 and a second end 103. The roof pole 2*a* and the leg pole middle section 2*b* are pivotally coupled by a pivoting joint 21. In the preferred embodiment, the pivoting joint 21 is constructed as described in U.S. Pat. No. 7,942,159, which is incorporated by reference in its entirety, but the pivoting joint 21 can be constructed by any other conventional coupling means.

Figure 10:
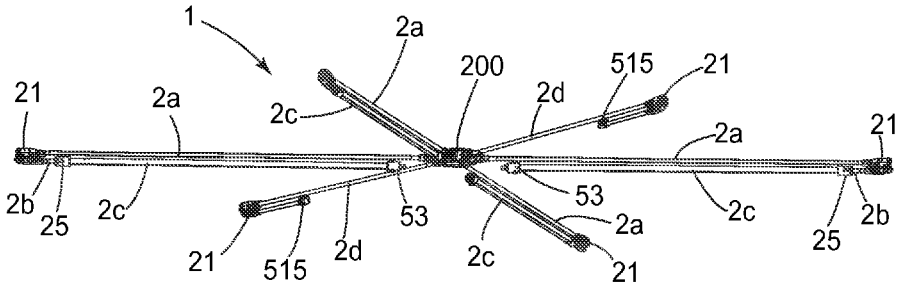
FIG. 10 is a side perspective view of the frame shown in FIG. 9 in a partially closed or folded configuration.

Referring again to FIGS. 1 and 9, each leg pole lower section 2*c* includes first and second ends 122, 123. The inner diameter of the lower section 2*c* is substantially similar to the outer diameter of the middle section 2*b* such that the middle section 2*b* is telescopically slidable within the lower section 2*c*. The second end of the middle section 103 is provided with a locking member 25. Each telescoping lower section 2*c* includes a spring loaded detent pin for indexing in apertures provided in each corresponding middle section 2*b* for locking the leg pole 2*b*, 2*c* in an extended position as shown in FIGS. 1 and 9, and depressing the detent pin to disengage the apertures to unlock and retract the leg pole lower section 2*c* as shown in FIGS. 10 and 11B. It is preferred that the length of the lower section 2*c* is less than or equal to the length of the middle section 2*b* such that when retracted substantially all of the middle section 2*b* is stored within the lower section 2*c*. The length of the retracted leg pole 2*b*, 2*c* is less than the distance between the top surface of the base 12*a* and the second end of the roof pole 73 so that the retracted leg pole 2*b*, 2*c* could be folded and stored above the base 12 as shown in FIG. 11B. Each extendable lower section 2*c* also preferably includes a foot 53 for engagement with the ground or other floor surface.

One of ordinary skill in the art will recognize that multiple spring loaded detent pin-aperture combinations could be included in each leg pole 2*b*, 2*c* such that the leg poles 2*b*, 2*c* could be adjusted to different lengths. It will also be recognized that any other conventional means for connecting the leg poles 2*b*, 2*c* could be used, including but not limited to slidable and pivotal connections. It is also possible to couple multiple leg poles to a single roof pole, as described in China App. Pub. No. CN201474367U which is incorporated by reference in its entirety, to provide additional surface area for the floor of the tent (described below) as well as to provide additional support to the frame.

Referring to FIGS. 1-5, the tent 1 includes a tent canopy 55. In the preferred embodiment, the tent canopy 55 is water and flame resistant, and is a fabric constructed from materials such as cotton, polyester or nylon, or any combination thereof. The tent canopy 55 can also be constructed with heat reflecting material.

In the preferred embodiment, as shown in FIGS. 1-5, the tent canopy 55 is an enclosure which includes four canopy walls and a floor. The tent canopy preferably includes windows 501 on three canopy walls with each window 501 having two overlapping layers. The outside layer of each window is constructed of a permeable fabric such as mesh or the like and is sewn into the remaining fabric of the tent canopy 55. The permeable fabric allows outside air to enter the tent interior while also protecting the interior from bugs and debris. The inside layer is constructed of the water and flame resistant material described above, and is partially removable via a fastener such as a zipper or the like which is sewn into the remaining fabric of the tent canopy. The inside layer acts as a barrier between the interior of the tent and the outside such that when closed, the interior of the tent is protected from outside elements such as wind, rain or snow. Alternatively, the mesh outside layer of each window can be replaced with a transparent non-permeable material such as vinyl and the inside layer can be replaced with a shading device or curtain.

Figure 4:
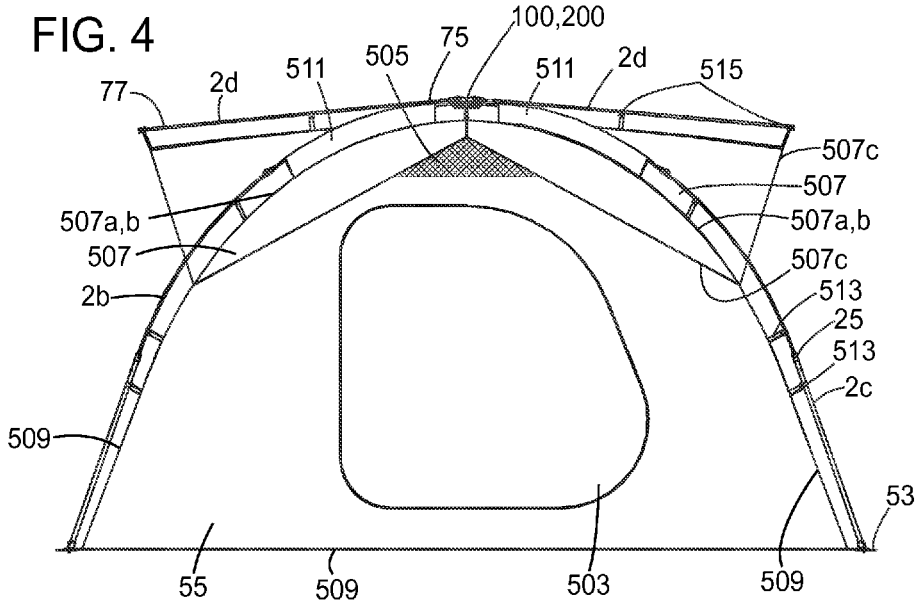
FIG. 4 is a side view of the instant tent of an alternative embodiment of the present invention.

The fourth side of the tent canopy is also equipped with a double layer of fabric identical to that of the three windows except that the mesh outer layer as well as the canopy fabric inner layer are both partially removable via fasteners thereby providing the tent with a door 503 for entering and exiting the tent, as shown in FIG. 4. One ordinarily skilled in the art will recognize that the number of sides as well as the number of windows and doors could vary depending on preference and design without departing from the scope of the present invention.

Figure 5:
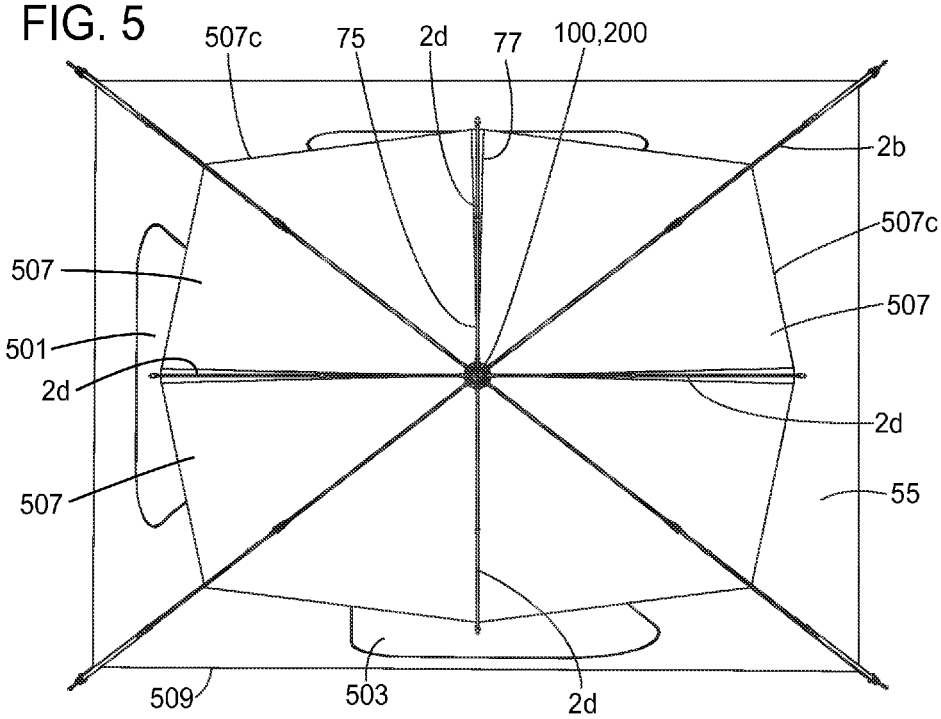
FIG. 5 is a top view of the instant tent shown in FIG. 4.

Referring to FIGS. 1-5, the top portion of the tent canopy 55 on each side of the tent 1 where the eave poles 2*d* are located also includes a permeable fabric 505 such as mesh. The permeable fabric improves ventilation for the tent interior while also protecting the interior from bugs and debris. In the preferred embodiment, the permeable section 505 is triangular and is located above the windows 501. One of ordinary skill in the art will recognize that a permeable fabric can be added to any number of sides of the tent and also take on other shapes and sizes without departing from the scope of the invention. For example, as shown in FIGS. 4-5, a permeable section can be included on all sides of the tent canopy provided that additional eave poles 2*d* and rain flies 507 (described in more detail below) are included on those sides.

As shown in FIGS. 1-5, the canopy 55 is connected to each pole 2*a*, 2*b*, 2*c* proximate seams 509 which join the canopy walls. A sleeve 511 extends from each seam 509 and is connected to the roof pole 2*a*. Three separate hooks 513 also extend from each seam 509 and are movably connected to the first and second ends of the middle section 101, 103 and at the first end of the lower section 122. In the preferred embodiment, the sleeve 511, instead of hooks, is provided on the roof pole 2*a* not only for aesthetic purposes but also because the length of the roof pole 2*a* remains constant throughout the opening and collapsing of the tent 1 and therefore a movable connection, i.e., a hook, is not required. The sleeve further provides the top portion of the canopy 55 with sufficient tension such that the top portion of the canopy does not sag.

One with ordinary skill in the art will recognize that the various connecting methods as well as locations of the connections could vary without departing from the spirit and scope of the invention. An outer surface of the tent canopy at a top center location 55*a* can also be provided with a string 55*b* (see, e.g., FIG. 2B) attached to a bottom portion of the hub 55*c* (see, e.g., FIGS. 8A-D) to provide additional stability to the tent 1 as well as to ensure that the tent canopy 55 does not sag.

Referring again to FIGS. 1-5, the tent 1 also includes a rain fly 507 preferably constructed of the same material as the tent canopy 55 described above. The preferred embodiment includes two substantially triangular rain flies 507 on opposing sides of the tent 1. Each rain fly 507 has three perimeters 507*a*, 507*b*, 507*c*. Two of the three perimeters 507*a*, 507*b* are sewn into corresponding seams of the tent canopy 509 and culminate at the center of the tent canopy 55*a*. The remaining perimeter of each rain fly 507*c* is a free end which rests above the canopy wall. Each rain fly 507 is attached to a corresponding eave pole 2*d* along a line extending from the center of the tent 55*a* to a midpoint of the remaining perimeter 507*c* and are attached to each eave pole 2*d* at the midpoint of the perimeter 507*c* to provide further support for the rain fly 507 and also to provide a decline on each side of the rain fly 507 to eliminate the possibility of water or debris accumulating on top of the rain fly 507. The hook 515 located at the second end of the eave pole 77 is permanently attached so that the rain fly 507 is taut when the tent is opened without the user having to make any adjustments.

The rain fly 507 also sufficiently covers the permeable upper portion of the tent canopy 505 and protects the permeable portion 505 and the interior of the tent 1 from rain or snow and also provides shading. Furthermore, because there is sufficient space between the rain fly 507 and permeable portion 505, air from the exterior of the tent 1 can enter and exit the tent interior uninhibitedly to provide continuous ventilation. Furthermore, the windows 501 located beneath the rain flies 507 are provided with overhead protection as well. One of ordinary skill in the art will recognize that the size, shape and number of the rain flies could vary. For example, as shown in FIGS. 4-5, a rain fly can be added to all sides of the tent 1.

In operation, the collapsed tent 1 (see, e.g., FIG. 11B) is erected by pulling the roof poles 2*a*, leg poles 2*b*, 2*c* and eave poles 2*d* radially outward from the hub 1 (see FIG. 10) and then unfolding and extending the leg poles 2*b*, 2*c* radially outward (see FIG. 9). Only the frame of the tent is illustrated in these drawings to clearly show the instant tent 1 in the closed and partially closed configurations.

In the first embodiment, the first ends of each roof pole and eave pole 71, 75 are secured within each corresponding slot 11 on the top surface of the base 12*a* and the curved outer surface 31 of the caps 3 and the curved grooves 111 of the slot walls 51 are engaged (see, e.g., FIG. 6). Similarly, in the second embodiment, the first ends of each pole 71, 75 is secured within each corresponding slot 11 as the caps of each roof pole and eave pole 3 engages the bottom surface of the base 12*b* and the slot walls 51 (see, e.g., FIGS. 8A-D).

Referring to FIG. 1, each roof pole second end 73 and leg pole middle portion first end 101 are aligned and engaged as described in U.S. Pat. No. 7,942,159 or by any other conventional means. The leg pole lower section 2*c* is telescopically extended and locked to the middle section 2*b* via the locking member 25 by engaging the push pin with the aperture. The poles 2*a*, 2*b*, 2*c* are pulled radially outward to fully expand the tent canopy 55 and rain flies 507, the feet of the poles 53 are then fixed to the surface, and the tent 1 remains opened and securely erected. The tent 1 is further stabilized by downward forces exerted on the poles 2*a*, 2*b*, 2*c* by the tent canopy 55 through the various attachments (hooks 513 and sleeves 511) which tend to keep the poles 2*a*, 2*b*, 2*c* from pivoting upward.

To close the tent 1, the feet of the poles 53 are first disengaged from the supporting surface and the overall tension in the tent canopy 55 is decreased. Referring to FIG. 10, the lower sections of the poles 2*c* are telescopically retracted by disengaging the push pin and aperture of the locking mechanism 25. The roof pole 2*a* and leg pole middle portion 2*b* are pulled apart and each section is pivotally disengaged via the pivoting joint 21. The leg poles 2*b*, 2*c* and the tent canopy 55 are then folded radially inward toward the hub 100, 200. The poles are pivoted radially inward until the poles 2*a-d* (and canopy 55) are gathered above the hub 100, 200 in a compact closed configuration for convenient storage and transportability. In the first embodiment, the caps 3 are pivoted within the slots 11 above the top surface of the base 12*a*. In the second embodiment, the caps 3 are pivoted within the voids 61 of the base 12 such that the caps 3 remain within the voids 61 as shown in FIG. 11A and extend below the bottom surface of the base 12*b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A foldable tent convertible between an open configuration and a folded configuration, said tent comprising:

a central hub comprising: a support member having an engaging surface; and first and second sets of slots formed on said engaging surface, each slot of the first and second set formed by first and second slot walls, each of the first and second slot walls extending from the engaging surface of the support member substantially parallel to each other, the first set of slots comprising at least three slots spaced apart radially, the second set of slots comprising at least one slot disposed between adjacent slots of the first set;

at least one eave pole corresponding to the number of slots of the second set of slots, each eave pole having first and second ends, each eave pole first end pivotally coupled to a corresponding slot of the second set;

a plurality of roof poles corresponding to the number of slots of the first set of slots, each roof pole having a first and second end, each roof pole first end pivotally coupled to a corresponding slot of the first set;

a plurality of leg poles corresponding to the number of roof poles, each leg pole having a middle section and a lower section, each middle and lower section having a first end and a second end, wherein each roof pole second end is coupled to a corresponding middle section first end, and said middle section second end is coupled to a corresponding lower section first end;

a canopy comprising a plurality of adjoining canopy walls and a floor coupled together at seams to form an enclosure, at least one canopy wall having a vent, wherein the canopy is connected to the roof poles and leg poles in the open and folded configurations; and at least one rain fly disposed above the vent, the at least one rain fly having a plurality of perimeters, wherein the at least one rain fly is connected to the canopy and corresponding at least one eave pole in the open and folded configurations;

wherein two adjacent perimeters of the at least one rain fly are coupled to corresponding seams of the at least one canopy wall having the vent.

2. The foldable tent in claim 1, wherein the at least one eave pole is coupled to the at least one rain fly between the two adjacent perimeters.

3. The foldable tent in claim 1, wherein the engaging surface is a bottom surface of the support member.

4. The foldable tent in claim 1, wherein the engaging surface is a top surface of the support member.

5. The foldable tent in claim 1, wherein the at least one eave pole comprises at least two collapsible sections.

6. The foldable tent in claim 5, wherein the at least two collapsible sections are pivotally coupled together.

7. The foldable tent in claim 1, wherein the middle and lower sections of each leg pole are slidably engaged.

8. The tent frame in claim 7, wherein the middle section is a fiberglass pole and the lower section is a tubular metal such that said middle and lower sections are telescopically engaged.

9. The foldable tent in claim 1, wherein the vent is constructed of a permeable material.

10. The foldable tent in claim 1, wherein the vent is an opening on the at least one canopy wall selected from a group comprising a door and a window.

11. A foldable tent convertible between an open configuration and a folded configuration, said tent comprising:

a central hub comprising: a support member having an engaging surface; and first and second sets of slots formed on said engaging surface, each slot of the first and second set formed by first and second slot walls, each of the first and second slot walls extending from the engaging surface of the support member substantially parallel to each other, the first set of slots comprising at least three slots spaced apart radially, the second set of slots comprising at least one slot disposed between adjacent slots of the first set;

at least one eave pole corresponding to the number of slots of the second set of slots, each eave pole having first and second ends, each eave pole first end pivotally coupled to a corresponding slot of the second set;

a plurality of roof poles corresponding to the number of slots of the first set of slots, each roof pole having a first and second end, each roof pole first end pivotally coupled to a corresponding slot of the first set;

a plurality of leg poles corresponding to the number of roof poles, each leg pole having a middle section and a lower section, each middle and lower section having a first end and a second end, wherein each roof pole second end is coupled to a corresponding middle section first end, and said middle section second end is coupled to a corresponding lower section first end;

a canopy comprising a plurality of adjoining canopy walls and a floor coupled together at seams to form an enclosure, at least one canopy wall having a vent, wherein the canopy is connected to the roof poles and leg poles in the open and folded configurations; and at least one rain fly disposed above the vent, the at least one rain fly having a plurality of perimeters, wherein the at least one rain fly is connected to the canopy and corresponding at least one eave pole in the open and folded configurations;

wherein the at least one rain fly is substantially triangular in shape having three perimeters.

12. The foldable tent in claim 11, wherein the engaging surface is a bottom surface of the support member.

13. The foldable tent in claim 11, wherein the engaging surface is a top surface of the support member.

14. The foldable tent in claim 11, wherein the at least one eave pole comprises at least two collapsible sections.

15. The foldable tent in claim 14, wherein the at least two collapsible sections are pivotally coupled together.

16. The foldable tent in claim 11, wherein the middle and lower sections of each leg pole are slidably engaged.

17. The tent frame in claim 16, wherein the middle section is a fiberglass pole and the lower section is a tubular metal such that said middle and lower sections are telescopically engaged.

18. The foldable tent in claim 11, wherein the vent is constructed of a permeable material.

19. The foldable tent in claim 11, wherein the vent is an opening on the at least one canopy wall selected from a group comprising a door and a window.

* * * * *